US007971870B2

(12) United States Patent
Lee et al.

(10) Patent No.: US 7,971,870 B2
(45) Date of Patent: Jul. 5, 2011

(54) MEDIUM FEEDING UNIT AND IMAGE FORMING APPARATUS HAVING THE SAME

(75) Inventors: Kang-woo Lee, Yongin-si (KR); Kwon-cheol Lee, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 262 days.

(21) Appl. No.: 12/164,267

(22) Filed: Jun. 30, 2008

(65) Prior Publication Data

US 2009/0066006 A1 Mar. 12, 2009

(30) Foreign Application Priority Data

Sep. 12, 2007 (KR) ..... 10-2007-0092766

(51) Int. Cl.
*B65H 1/00* (2006.01)

(52) U.S. Cl. ..... 271/145

(58) Field of Classification Search ..... 271/145, 271/147, 9.03; 221/6
See application file for complete search history.

(56) References Cited

U.S. PATENT DOCUMENTS 5,480,131 A * 1/1996 Furukawa et al. ..... 271/9.06
6,917,766 B2 * 7/2005 Phillips et al. ..... 399/23
7,063,315 B2 * 6/2006 Lyu et al. ..... 271/38

FOREIGN PATENT DOCUMENTS

KR 1999-55944 7/1999

* cited by examiner

*Primary Examiner* — Michael C McCullough
(74) *Attorney, Agent, or Firm* — Staas & Halsey LLP

(57) ABSTRACT

A medium feeding unit having an improved structure for sensing that the number of print media loaded onto a loading plate is equal to or exceeds a predetermined remaining number, and an image forming apparatus having the same. The medium feeding unit includes a sensor that outputs sensing signals having different voltages according to quantities of received light. The medium feeding unit also includes a plurality of actuators that sense the number of print media on a loading plate, differentially intercept the sensing area of the sensor thus changing the voltage level of the sensing signal, and therefore signal the medium feeding unit when the number of print media on the loading plate falls below the predetermined remaining number.

20 Claims, 5 Drawing Sheets

MEDIUM FEEDING UNIT AND IMAGE FORMING APPARATUS HAVING THE SAME

CROSS-REFERENCE TO RELATED APPLICATION

This application claims the benefit of Korean Application No. 2007-92766, filed Sep. 12, 2007 in the Korean Intellectual Property Office, the disclosure of which is incorporated herein by reference.

BACKGROUND OF THE INVENTION

1. Field of the Invention

Apparatuses and methods consistent with aspects of the present invention relate to a medium feeding unit for loading and supplying a print medium and an image forming apparatus having the same, and more particularly, to a medium feeding unit having an improved structure for sensing the number of loaded print media and an image forming apparatus having the same.

2. Description of the Related Art

An image forming apparatus includes a medium feeding unit provided with a loading plate where a print medium is loaded, and an image forming unit to form a visual image with a developer on the print medium. During a printing operation, the print media on the loading plate are picked up sheet-by-sheet and fed to the image forming unit.

Before the printing operation, the loading plate has to be loaded with the print media. To sense whether or not the print media are loaded onto the loading plate, a sensing unit is installed in the medium feeding unit. With regard to such a sensing unit, various configurations and operating methods have been proposed.

For example, a conventional sensing unit includes a sensor in which a light emitting portion and a light receiving portion are integrated with each other, and a through hole formed in the loading plate that can pass a beam emitted from the light emitting portion of the sensor therethrough. If the loading plate is not loaded with any print media, the beam emitted from the light emitting portion travels undisturbed via the through hole, so that the light receiving portion does not receive any portion of the beam. On the other hand, the through hole is blocked when the print medium is loaded into the loading plate. Therefore, if the loading plate is loaded with some print media, the print media block the through hole and the beam is reflected or scattered from the surface of the print medium so that the light receiving portion can receive a portion or all of the beam reflected or scattered from the surface of the print media. Accordingly, it is possible to sense whether or not print media are loaded onto the loading plate.

However, the conventional sensing unit only senses the existence of print media, so that a user can only recognize absence of print media when the loading plate is empty. In other words, a user does not know whether or not the number of loaded print media is enough to complete the printing operation. Accordingly, when the print media are exhausted the image forming apparatus may suspend printing during the printing operation.

Meanwhile, in the case of a tandem-type image forming apparatus, an image is first formed on an image carrying body or on an intermediate transfer belt before being transferred to a print medium, to thereby enhance speed of the printing operation. However, if the print media are exhausted during the printing operation and the tandem-type image forming apparatus suspends operation, the image previously formed on the image carrying body or the intermediate transfer belt not only is not used but may need to be cleaned off before the image forming apparatus can be used again. Accordingly, problems arise, for example, developer is wasted; the system load increases because of the cleaning process; and the next print medium may be contaminated in the next printing operation.

SUMMARY OF THE INVENTION

Accordingly, aspects of the present invention provide a medium feeding unit having an improved structure for sensing that the number of print media loaded onto a loading plate is equal to or exceeds a predetermined remaining amount, and an image forming apparatus having the same.

The foregoing and/or other aspects of the present invention can be achieved by providing a medium feeding unit comprising: a supporting frame; a loading plate where print media are loaded; a sensor that comprises a sensing area and outputs sensing signals having different levels corresponding to portions of the sensing area blocked; a first actuator that rotates with respect to a shaft provided in the supporting frame as a first end part of the first actuator interferes with the print media on the loading plate, and makes a second end part of the first actuator rotate between a first reference position at which a predetermined first region of the sensing area is blocked or opened and a first sensing position moved away from the first reference position at which a predetermined first region of the sensing area is blocked; and a second actuator that rotates with respect to the shaft as a first end part of the second actuator interferes with the print media that are loaded onto the loading plate more than a predetermined reference remaining number, and makes a second end part of the second actuator thereof rotate between a second reference position at which a predetermined second region, different from the first region blocked by the first actuator, of the sensing area is blocked or opened and a second sensing position moved away from the second reference position.

The sensor may comprise: a light emitting portion; and a light receiving portion that forms the sensing area to receive a light emitted from the light emitting portion and outputs the sensing signals having different levels according to quantities of received light. The level of the sensing signal may comprise a voltage level corresponding to the quantity of the received light.

The first actuator may block the predetermined first region of the sensing area at the first reference position, and the second actuator blocks a smaller region of the sensing area than the predetermined first region blocked by the first actuator at the second reference position. The loading plate may comprise an accommodating portion to accommodate the first end part of the first actuator when the loading plate is empty, and at the first reference position, the first end part of the first actuator is received in the accommodating portion and the second end part thereof blocks the entire sensing area.

The first actuator may be disposed at the first reference position when the loading plate is empty, and the second actuator is disposed at the second reference position when the loading plate is empty and when the print media do not exceed the reference remaining amount. The first actuator and the second actuator may rotate independently of each other.

The medium feeding unit may further comprise a controller to determine whether print media are loaded onto the loading plate and whether the total number of print media is equal to or less than the reference remaining number on the basis of the level of the sensing signal.

When the controller may determine that the loading plate is empty or the number of print media is equal to or less than the reference remaining number, the determined result is displayed on a display portion provided in an image forming apparatus or transmitted to a host apparatus communicating with the image forming apparatus.

The foregoing and/or other aspects of the present invention can be achieved by providing an image forming apparatus comprising: a medium feeding unit that comprises: a supporting frame; a loading plate where print media are loaded; a sensor that comprises a sensing area and outputs sensing signals having different levels corresponding to portions of the sensing area blocked; a first actuator that rotates with respect to a shaft provided in the supporting frame when a first end part of the first actuator interferes with the print media on the loading plate, and makes a second end part of the first actuator rotate between a first reference position at which a predetermined first region of the sensing area is blocked or opened and a first sensing position moved away from the first reference position at which a predetermined first region of the sensing area is blocked; and a second actuator that rotates with respect to the shaft as a first lower end part of the second actuator interferes with the print media that are loaded onto the loading plate more than a predetermined reference remaining number, and makes a second end part of the second actuator rotate between a second reference position at which a predetermined second region, different from the first region blocked by the first actuator, of the sensing area is blocked or opened and a second sensing position moved away from the second reference position; and an image forming unit which forms an image on the print medium fed from the medium feeding unit.

The image forming apparatus may further comprise a controller to determine whether print media are loaded onto the loading plate and whether the total number of print media is equal to or less than the reference remaining number on the basis of the level of the sensing signal. When the controller may determine that the loading plate is empty or the number of print media is equal to or less than the reference remaining amount, the determined result is displayed on a display portion provided in the image forming apparatus or transmitted to a host apparatus communicating with the image forming apparatus.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings in which.

DETAILED DESCRIPTION OF THE EMBODIMENTS

Figure 1:
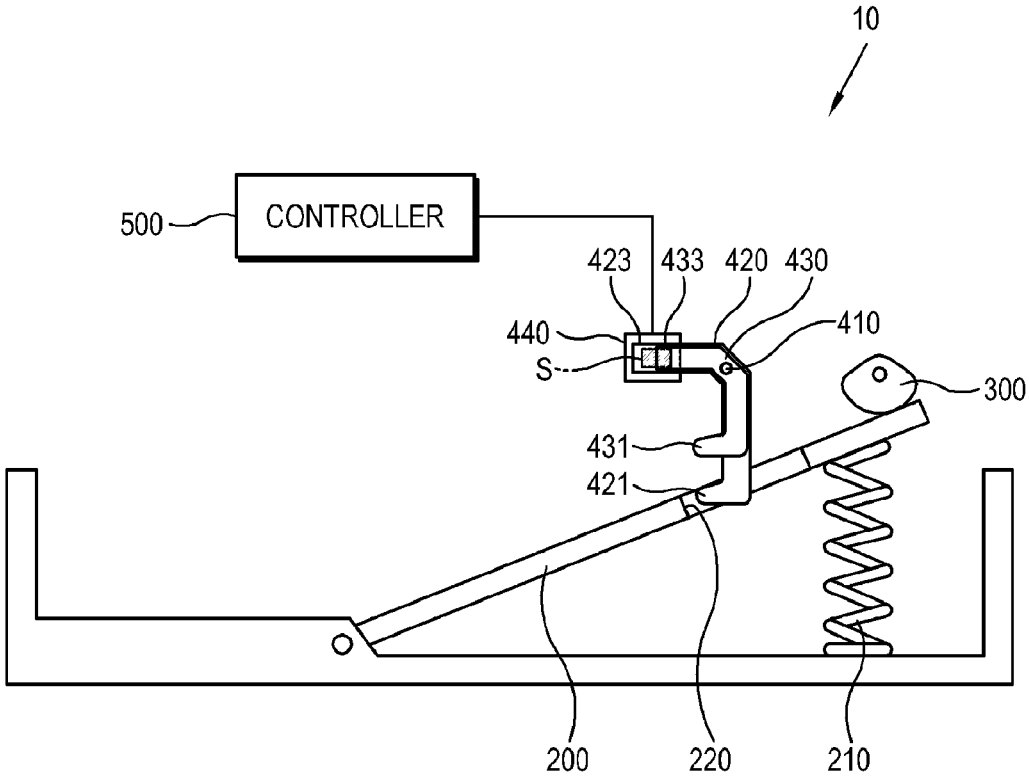
FIG. 1 is a lateral-section view illustrating that a medium feeding unit according to an exemplary embodiment of the present invention is empty.

Reference will now be made in detail to the embodiments of the present invention, examples of which are illustrated in the accompanying drawings, wherein like reference numerals refer to like elements throughout. The embodiments are described below in order to explain the present invention by referring to the figures.

As shown in FIGS. 1 through 4, a medium feeding unit 10 employed in an image forming apparatus 1 (see FIG. 5) according to an example embodiment of the present invention includes a supporting frame 100 (see FIG. 2) to which structural components are coupled and supported, a loading plate 200 where print media M are loaded, and a medium sensing unit 400 (also see FIG. 2) that senses the existence of and a predetermined remaining number of print media. Further, the medium sensing unit 400 includes a sensor 440 having a sensing area S; a first actuator 420 rotating in cooperation with the print media M loaded onto the loading plate 200 and blocking a predetermined first region of the sensing area S; and a second actuator 430 rotating in cooperation with the loaded print media M and blocking a predetermined second region of the sensing area S that is smaller than the region blocked by the first actuator 420. Further, the medium feeding unit 10 includes a pick-up roller 300 placed above the loading plate 200 and picking up the topmost print medium M of the loaded print media M on the loading plate 200.

The loading plate 200 is shaped like a plate (that is, flat with elevated sides) and the print media M are loaded on the top surface thereof of the loading plate 200. The loading plate 200 has an upper end part that is freely rotatable and a lower end part that serves as a hinge. An elastic member 210 such as a coil spring or the like is provided below the loading plate 200. The elastic member 210 elastically boosts the bottom surface of the loading plate 200 up, so that the topmost print medium M of the loaded print media M on the loading plate 200 can reach a position to be picked up by the pick-up roller 300.

Further, the loading plate 200 includes an accommodating portion 220. Here, the accommodating portion 220 may be provided as a groove recessed on the top surface of the loading plate 200 or a hole penetrating the loading plate 200. The accommodating portion 220 receives a part of the first actuator 420, i.e., a first end part 421 of the first actuator 420 (to be described later) when the loading plate 200 is empty. If the loading plate 200 is loaded with one print medium M or more, the accommodating portion 220 is blocked off by the print media M such that the first end part 421 of the first actuator 420 is not received therein.

The first actuator 420 includes the first end part 421 extending from a shaft 410 toward the top surface of the loading plate 200, and a second end part 423 extending from the shaft 410 in a different direction from the first end part 421. The first end part 421 is rotated by interference with at least one print medium M loaded on to the loading plate 200, and the second end part 423 blocks or opens a predetermined first region of the sensing area S in cooperation with the first end part 421.

Figure 2:
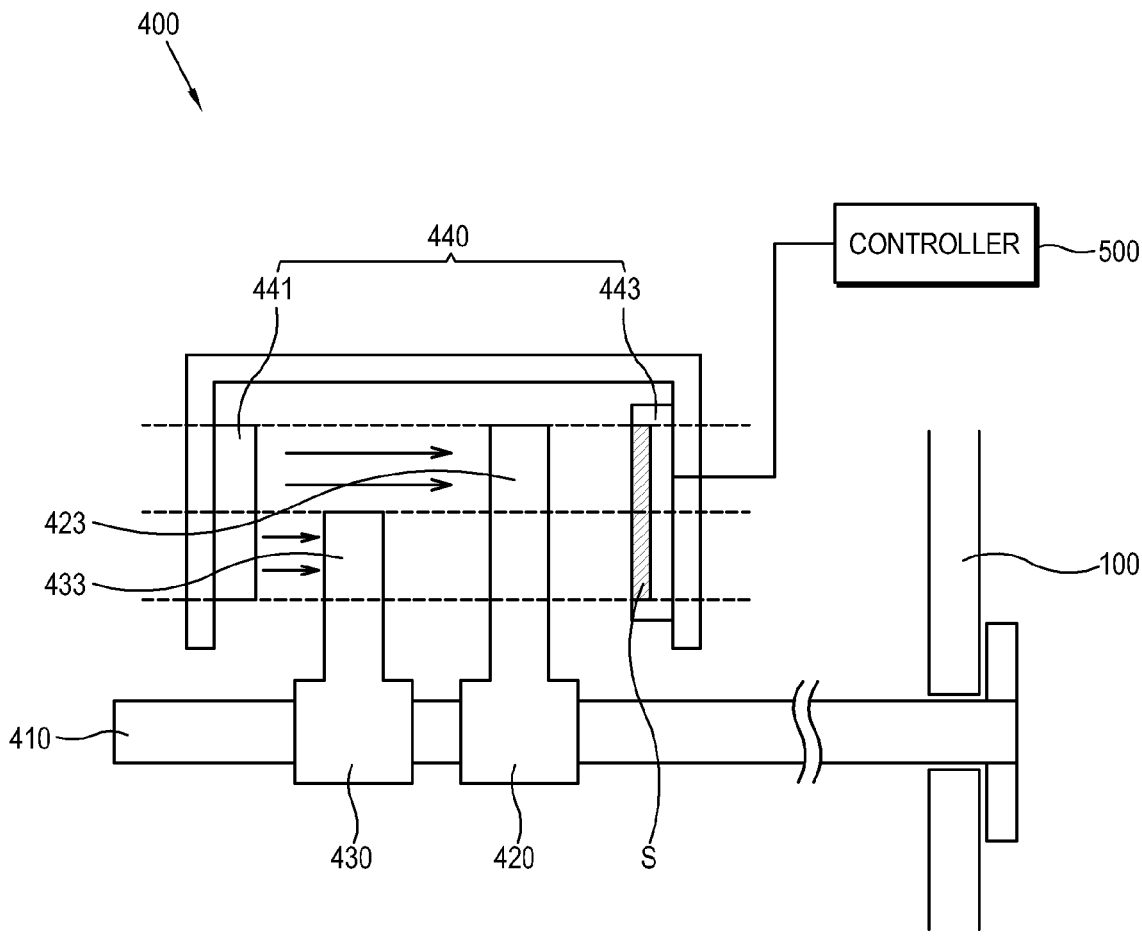
FIG. 2 is a top-section view showing a medium sensing unit in the medium feeding unit of FIG. 1.
Figure 3:
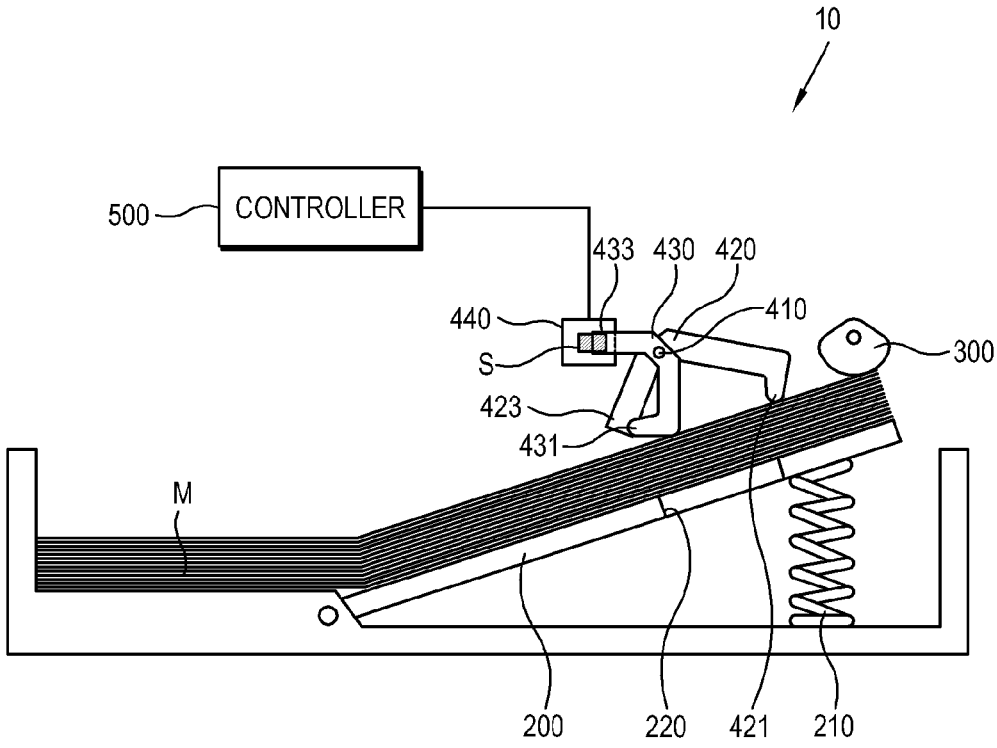
FIG. 3 is a lateral-section view illustrating that the amount of loaded print media is equal to a reference remaining amount in the medium feeding unit according to the example embodiment of FIG. 1.
Figure 4:
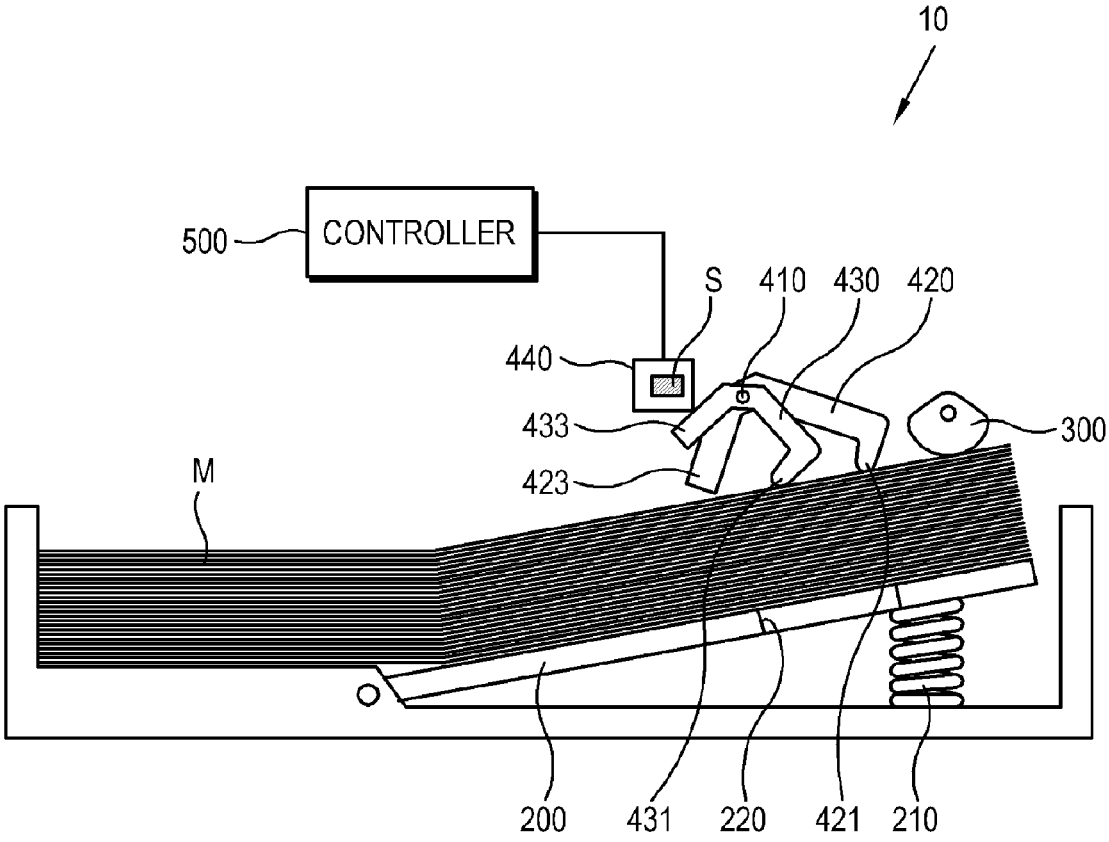
FIG. 4 is a lateral-section view illustrating that the amount of loaded print media exceeds the reference remaining amount in the medium feeding unit according to the example embodiment of FIG. 1.

When the loading plate 200 is empty, the first end part 421 is received in the accommodating portion 220 and the second end part 423 blocks the entire area of the sensing area S (refer to FIGS. 1 and 2). This position of the first actuator 420 will be called a first reference position. In other words, when the first actuator 420 has been rotated to the first reference position it indicates that the loading plate 200 is empty.

The second actuator 430 includes a first end part 431 extending from the shaft 410 toward the top surface of the loading plate 200, and a second end part 433 extending from the shaft 410 in a different direction from the first end part 431. The first end part 431 is rotated by interference with the print media M that are loaded onto the loading plate 200 more than a predetermined remaining number, and the second end part 433 blocks or opens a predetermined second region of the sensing area S in cooperation with the first end part 431. Here, the second region of the sensing area S that is blocked by the second end part 433 of the second actuator 430 is different from the first region blocked by the second end part 423 of the first actuator 420 rotated to the first reference position. In other words, the second region of the sensing area S blocked by the second end part 433 of the second actuator 430 is smaller than the first region blocked by the second end part 423 of the first actuator 420. For reference, the aforementioned remaining number indicates the number of print media M remaining when a user considers that the print media M that are required to be additionally loaded on to the loading plate 200. The number of print media M may be set to a range of numbers. Further, the number of print media M may be set during manufacture of the image forming apparatus or set by a user to a particular level for that medium feeding unit or different levels for each job.

The first actuator 420 and the second actuator 430 rotate independently of each other. When one of the first and second actuators 420 and 430 rotates, the other one operates regardless of this rotation. In other words, the first and second actuators 420 and 430 are each rotated by print media M loaded on the loading plate 200.

Further, when the first and second actuators 420 and 430 are released from interference with the print media M, the first and second actuators 420 and 430 return to their respective original positions. There is no limitation on the structure and structure related operation of the first and second actuators 420 and 430. For example, the first and second actuators 420 and 430 may return by their own weight or a spring (not shown) provided in the shaft 410.

There is no interference between the first end part 431 of the second actuator 430 and the print medium M if the loading plate 200 is empty and if the print media M on the loading plate 200 do not exceed the aforementioned remaining amount. The second end part 433 of the second actuator 430 blocks a smaller region of the sensing area S from the region blocked by the first actuator 420 at the first reference position. For example, the second end part 433 of the second actuator 430 blocks a half region of the sensing area S. When there is no interference between the first end part 431 of the second actuator 430 and the print media M, the position of the second actuator 430 will be called a second reference position. In other words, the second actuator 430 is rotated to the second reference position when the loading plate 200 is empty or when the print media M on the loading plate 200 do not exceed the aforementioned remaining number.

If a predetermined region of the sensing area S is blocked by the first and second actuators 420 and 430, the sensor 440 outputs a sensing signal corresponding to the blocked region. For this, the sensor 440 includes a light emitting portion 441 of emitting light, and a light receiving portion 443 forming the sensing area S to receive the light emitted from the light emitting portion 441 (Refer to FIG. 2).

The second end part 423 of the first actuator 420 and the second end part 433 of the second actuator 430 pass a light path between the light emitting portion 441 and the light receiving portion 443, so that at least one of the second end parts 423 and 433 blocks a predetermined partial region or the entire area of the sensing area S, i.e., the light path. Thus, the quantity of light received in the light receiving portion 443 varies according to the area of the blocked region of the sensing area S.

The light receiving portion 443 outputs a sensing signal having a level varying according to quantities of received light. The sensing signal may be achieved by various techniques. For example, the light receiving portion 443 may output a voltage as a function of the quantity of the received light.

In more detail, if the light receiving portion 443 receives the maximum quantity of light, the light receiving portion 443 outputs no voltage. On the other hand, if the quantity of light received in the light receiving portion 443 is zero, i.e., if the light receiving portion 443 receives no light, the light receiving portion 443 outputs a voltage of, for example, 3.3 V. Further, if the quantity of light received in the light receiving portion 443 is half the maximum quantity, the light receiving portion 443 outputs a voltage of 1.7 V. Such voltage levels are not limited thereto, and may vary.

The following example describes a case where the print media M are loaded onto the loading plate 200 in excess of a reference remaining amount (refer to FIG. 4), e.g., a case where the loading plate 200 is fully loaded with the print media M. At this time, the first actuator 420 and the second actuator 430 are largely moved away from the first reference position and the second reference position, that is, disposed at first and second positions, respectively. That is, the first end parts 421 and 431 are rotated by the interference with the printing media M, and both the second end parts 423 and 433 do not block the sensing area S, so that the light from the light emitting portion 441 is entirely received in the light receiving portion 443 without blocking. Thus, the light receiving portion 443 receives the maximum quantity of light and outputs no voltage (i.e., 0 V).

If a printing operation is performed, the number of the loaded print media M decreases and the first end part 431 of the second actuator 430 rotates downward. Simultaneously, a region of the sensing area S blocked by the second end part 433 of the second actuator 430 also increases gradually. Thus, the quantity of light received in the light receiving portion 443 decreases gradually, so that the voltage level output from the light receiving portion 443 increases.

As the printing operation continues, when the total number of printing media M loaded on the loading plate 200 becomes equal to the reference remaining amount (refer to FIG. 3), the second actuator 430 rotates to the second reference position. At this point, the first end part 431 of the second actuator 430 is not interfered with the print media M, and the second end part 433 of the second actuator 430 blocks (for this example, half of) the region of the sensing area S. The quantity of light received in the light receiving portion 443 becomes half the maximum quantity, and the light receiving portion 443 outputs a voltage of 1.7 V.

In reverse, it is possible to determine that the total number of print media M loaded on the loading plate 200 reaches the reference remaining amount if the light receiving portion 443 outputs a voltage of 1.7 V. In this case, a user may be made aware of an insufficient number of print media M; that situation will be described later.

If the loading plate 200 becomes empty as the printing operation consumes the print media M (refer to FIG. 1), the first actuator 420 rotates to the first reference position at which the first part 421 of the first actuator is received in the accommodating portion 220. In this case, the second end part 423 of the first actuator 420 blocks the entire area of the sensing area S, and the quantity of light received in the light receiving portion 443 is zero. Thus, the light receiving portion 443 outputs a voltage of 3.3 V.

According to an example embodiment of the present invention, the medium feeding unit 10 of the image forming apparatus includes a controller 500 to determine whether or not the print media M are loaded on to the loading plate 200 and whether or not the total number of print media M is equal to or less than the reference remaining number on the basis of the level of the sensing signal.

The controller 500 controls a memory (not shown) to store the level of the sensing signal output from the light receiving portion 443, i.e., the voltage level output from the light receiving portion 443 corresponding to the number of loaded print media M. Such values may be set during manufacture of the image forming apparatus 1 (see FIG. 5) or set by a user to a particular level for that medium feeding unit or different levels for each job.

For example, the controller 500 determines that the loading plate 200 is empty if the light receiving portion 443 outputs a voltage of 3.3 V. On the other hand, the controller 500 determines that the loading plate 200 is fully loaded with the print media M if the light receiving portion 443 outputs a voltage of 0 V. If the output voltage gradually increases from 0 V and becomes 1.7 V, the controller 500 determines the print medium M loaded on the loading plate 200 reaches the reference remaining amount.

When the controller 500 determines that the loading plate 200 is empty or the print medium M reaches the reference remaining amount, the controller 500 displays a determined result and notifies the user. Here, various notifying methods are applicable. For example, the determined result may be displayed on a display portion (not shown) provided in the image forming apparatus or transmitted to a host apparatus (not shown) communicating with the image forming apparatus through network or locally.

As described above, the regions of the sensing area S blocked by the respective first and second actuators 420 and 430 are different from each other, and the sensor 440 outputs the sensing signals having the different levels corresponding to the blocked regions, thereby sensing whether or not the print medium M is loaded on to the loading plate 200 and whether the number of loaded print media M reaches a predetermined remaining number.

Figure 5:
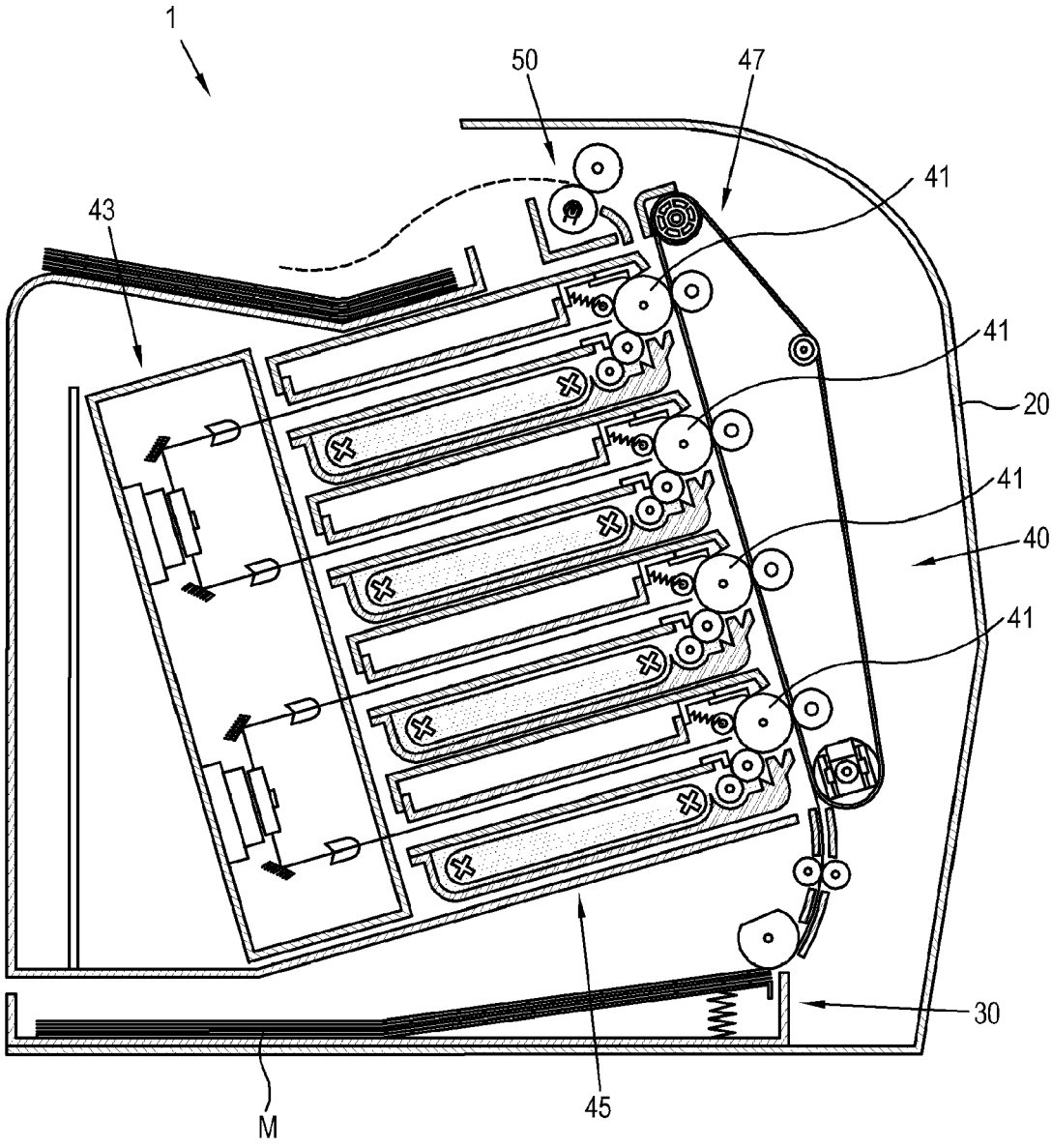
FIG. 5 is a lateral-section view of an image forming apparatus employing the media feeding unit according to another example embodiment of the present invention.

FIG. 5 is a lateral-section view of an image forming apparatus 1 according to another example embodiment of the present invention. As shown therein, the image forming apparatus 1 according to this example embodiment of the present invention includes a main body casing 20, a medium feeding unit 30 loaded with and supplying print media M, and an image forming unit 40 forming an image on the print medium M fed from the medium feeding unit 30.

The image forming unit 40 includes one or more image carrying bodies 41 on which a latent image and a visual image developed with a developer are formed, a light scanning unit 43 forming the latent image on the respective image carrying body 41, a developing unit 45 supplying the respective image carrying body 41 with the developer, and a transferring unit 47 transferring the visual image from the respective image carrying body 41 to the print medium M. Further, the image forming unit 40 includes a fusing unit 50 applying heat and pressure to the print media M having the respective transferred visual image, thereby fixing the visual image on the print media M.

In this embodiment, the image forming unit 40 may form an image by developing the visual image with the developer and then transferring it to print media M sheet by sheet, but the image forming unit 40 is not limited thereto. Alternatively, the image forming unit 40 may form an image by jetting ink to the print media M. Other techniques may also be used.

The medium feeding unit 30 is loaded with print media M and feeds the image forming unit 40 with the loaded print media M sheet by sheet. To make a user easily load the print medium M into the medium feeding unit 10, the medium feeding unit 30 is at least partially detachable from the main body casing 20. The medium feeding unit 30 is substantially same as the medium feeding unit 10 described above, and thus repeat descriptions will be avoided unless necessary.

By way of example, the one or more image carrying bodies 41 include four image carrying bodies 41 corresponding to yellow, magenta, cyan and black for forming a color image on the print media M, and they are arranged in sequence along a moving path of a print medium M. The surface of the respective image carrying body 41 is uniformly charged, and then registers a difference in electric potential because of a beam from the light scanning unit 43, thereby forming a latent image thereon. Then, developer is supplied from the developing unit 45 to an image carrying body 41 having the latent image, so that the image carrying body 41 has the visual image created by the developer.

The light scanning unit 43 scans the beam to form the latent images on the respective image carrying bodies 41. The light scanning unit 43 divides an original color image into predetermined colors and forms the latent images corresponding to the divided colors on the image carrying bodies 41.

The developing unit 45 contains as many image carrying bodies 41 as the number of developer colors needed for operation of the image forming unit 10; for the color black, only one image carrying body is necessary. Thus, visual images different in color are formed on the one or more image carrying bodies 41, respectively.

The transferring unit 47 transfers the visual images from the respective image carrying bodies 41 to a print medium M while moving the print medium M past the plurality of image carrying bodies 41 in sequence. Accordingly, the transferred visual images are overlapped on the print medium M.

In an example embodiment of the present invention, when the total number of print media loaded onto a loading plate reaches a predetermined remaining amount, that occurrence is sensed and displayed. Thus, a user can add print media to the loading plate before giving a printing order to the image forming apparatus, thereby preventing the image forming apparatus from suspending operation because of the lack of print media.

Accordingly, system load and developer loss are decreased, and the print media are prevented from contamination, thereby enhancing reliability of a product. Further, the foregoing aspects are achieved by one sensor, so that the structure is simplified, thereby minimizing complexity of the product, enhancing productivity and reducing production cost.

The example embodiments above show and describe two actuators so that one indicator of number of media left is displayed. Other embodiments are possible. For example, a medium feeding unit or image forming apparatus could be designed with three or more actuators such that two or more reference remaining numbers could be displayed. In this way, different reference remaining numbers could be set for different weights of print media, different print jobs or other needs of the user. In another example, since an electrical signal is transmitted to the controller, a continuum of numbers of print media could be sensed and outputted. The user could then dial in the number of copies desired and obtain an immediate signal if the number of print media on the loading plate is sufficient for the task.

Although a few embodiments of the present invention have been shown and described, it would be appreciated by those skilled in the art that changes may be made in these embodiments without departing from the principles and spirit of the invention, the scope of which is defined in the appended claims and their equivalents.

What is claimed is:

1. A medium feeding unit, comprising:

a supporting frame;

a loading plate where print media are loaded;

a sensor that comprises a sensing area and outputs sensing signals having different levels corresponding to blocking of the sensing area;

a first actuator that rotates with respect to a shaft provided in the supporting frame as a first end part of the first actuator interferes with the print media on the loading plate, and makes a second end part thereof rotate between a first reference position at which a predetermined first region of the sensing area is blocked or opened and a first position moved away from the first reference position; and a second actuator that rotates separately from the first actuator with respect to the shaft as a first end part of the second actuator interferes with the print media that are loaded on to the loading plate more than a predetermined reference remaining number greater than zero, and makes a second end part thereof rotate between a second reference position at which a predetermined second region, different from the first region blocked by the first actuator, of the sensing area is blocked or opened and a second position moved away from the second reference position.

2. The medium feeding unit according to claim 1, wherein the sensor comprises:

a light emitting portion; and a light receiving portion that forms the sensing area to receive light emitted from the light emitting portion and outputs the sensing signals having different levels according to quantities of received light.

3. The medium feeding unit according to claim 2, wherein a particular level of the sensing signals comprises a voltage level corresponding to the quantity of the received light.

4. The medium feeding unit according to claim 2, wherein the sensor is a single sensor.

5. The medium feeding unit according to claim 1, wherein the first actuator blocks the predetermined first region of the sensing area at the first reference position, and the second actuator blocks a smaller region of the sensing area than the predetermined first region blocked by the first actuator at the first reference position.

6. The medium feeding unit according to claim 5, wherein the loading plate comprises an accommodating portion to receive the first end part of the first actuator when the loading plate is empty, and at the first reference position, the first end part of the first actuator is received in the accommodating portion and the second end part thereof blocks the entire of the sensing area.

7. The medium feeding unit according to claim 1, wherein the first actuator is disposed at the first reference position when the loading plate is empty, and the second actuator is disposed at the second reference position when the loading plate is empty and when the print media do not exceed the reference remaining amount.

8. The medium feeding unit according to claim 1, wherein the first actuator and the second actuator rotate independently of each other.

9. The medium feeding unit according to claim 1, further comprising a controller to determine whether the print media are loaded onto the loading plate and whether the total number of print media is equal to or less than the reference remaining number on the basis of the level of the sensing signal.

10. The medium feeding unit according to claim 9, wherein, when the controller determines that the loading plate is empty or the number of print media are equal to or less than the reference remaining number, the determined result is displayed on a display portion provided in an image forming apparatus or transmitted to a host apparatus communicating with the image forming apparatus.

11. The medium feeding unit according to claim 10, wherein the predetermined reference remaining number is set by a manufacturer.

12. The medium feeding unit according to claim 10, wherein the predetermined reference remaining number is set by a user.

13. The medium feeding unit according to claim 10, wherein when a user sets the number of print media needed for one task, a controller determines if the number of print media remaining on the loading plate is sufficient for the task and if the number of print media is insufficient, the controller displays a warning signal.

14. An image forming apparatus, comprising:

a medium feeding unit that comprises:

a supporting frame;

a loading plate where print media are loaded;

a sensor that comprises a sensing area and outputs sensing signals having different levels corresponding to blocking of the sensing area;

a first actuator that rotates with respect to a shaft provided in the supporting frame as a first end part of the first actuator interferes with the print media on the loading plate, and makes a second end part thereof rotate between a first reference position at which a predetermined first region of the sensing area is blocked or opened and a first position moved away from the first reference position;

a second actuator that rotates separately from the first actuator with respect to the shaft as a first end part of the second actuator interferes with the print media that are loaded onto the loading plate more than a predetermined reference remaining number greater than zero, and makes a second end part of the second actuator rotate between a second reference position at which a predetermined second region, different from the first region blocked by the first actuator, of the sensing area is blocked or opened and a second position moved away from the second reference position; and an image forming unit that forms an image on the print media fed from the medium feeding unit.

15. The image forming apparatus according to claim 14, further comprising a controller to determine whether the print media are loaded onto the loading plate and whether the total number of print media are equal to or less than the reference remaining number on the basis of the level of the sensing signal.

16. The image forming apparatus according to claim 15, wherein, when the controller determines that the loading plate is empty or the number of print media are equal to or less than the reference remaining number, a determined result is displayed on a display portion provided in the image forming apparatus or transmitted to a host apparatus communicating with the image forming apparatus.

17. The image forming apparatus according to claim 16, wherein the predetermined reference remaining number is set by a manufacturer.

18. The image forming apparatus according to claim 16, wherein the predetermined reference remaining number is set by a user.

19. The image forming apparatus according to claim 16, wherein when a user sets the number of print media needed for one task, the controller determines if the number of print media remaining on the loading plate is sufficient for the task and if the number of print media is insufficient, the controller displays a warning signal.

20. A method of operation of an image forming apparatus comprising an image forming unit, a controller and a medium feeding unit that comprises a supporting frame, a loading plate, a sensor, a first actuator with a first and second end part, and a second actuator with a first and second end part, the method comprising:

placing print media on the loading plate;

operating the image forming unit;

sensing when the number of print media reaches a predetermined reference remaining number greater than zero; and displaying a signal that the number of print media remaining on the loading plate is insufficient for further printing, wherein the sensor is a single sensor which has a predetermined sensing area and outputs sensing signals having different levels corresponding to a blocking size of the sensing area, the first end parts of the first actuator and the second actuator respectively rotate by interfering with the reference remaining number of print media on the loading plate, and a first region and a second region of the sensing area blocked respectively by the second end parts of the first actuator and the second actuator are different sizes.

* * * * *